US006818138B2

(12) United States Patent
Obert et al.

(10) Patent No.: US 6,818,138 B2
(45) Date of Patent: Nov. 16, 2004

(54) SLOTTED SUBSTRATE AND SLOTTING PROCESS

(75) Inventors: Jeffrey Scott Obert, Corvallis, OR (US); Eric L. Nikkel, Philomath, OR (US); Kenneth M. Kramer, Corvallis, OR (US); Steven D Leith, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/888,975

(22) Filed: Jun. 22, 2001

(65) Prior Publication Data

US 2002/0195420 A1 Dec. 26, 2002

(51) Int. Cl.[7] ..... B41J 2/04

(52) U.S. Cl. ..... 216/27; 216/17; 216/41; 347/65

(58) Field of Search ..... 216/17, 27, 41; 347/65

(56) References Cited

U.S. PATENT DOCUMENTS 4,579,812 A * 4/1986 Bower ..... 430/313
5,565,084 A 10/1996 Lee et al.
5,569,355 A * 10/1996 Then et al. ..... 438/20
5,877,791 A * 3/1999 Lee et al. ..... 347/63
6,133,131 A * 10/2000 Lai ..... 438/595
6,143,190 A * 11/2000 Yagi et al. ..... 216/27
6,376,833 B2 * 4/2002 Shimada et al. ..... 250/234

FOREIGN PATENT DOCUMENTS

EP 0841167 5/1998

OTHER PUBLICATIONS

EP Search Report dated Oct. 7, 2002.

* cited by examiner

*Primary Examiner*—Robert Kunemund
*Assistant Examiner*—Shamim Ahmed

(57) ABSTRACT

A method of manufacturing a slotted substrate includes forming a masking layer over a first surface of a substrate, and patterning and etching the masking layer to form a hole therethrough. The first layer is deposited over the masking layer and in the hole. The first layer is patterned and etched to form a plug in the hole. A second surface of the substrate that is opposite the first surface is continuously etched until a bottom surface of the plug is substantially exposed and a slot in the substrate is substantially formed.

16 Claims, 6 Drawing Sheets

SLOTTED SUBSTRATE AND SLOTTING PROCESS

FIELD OF THE INVENTION

The present invention relates to slotted substrates, used in microfluidic devices such as fluid ejection devices.

BACKGROUND OF THE INVENTION

Generally, thermally actuated printheads use resistive or heating elements to achieve fluid or ink expulsion. A representative thermal inkjet printhead has a plurality of thin film resistors provided on a semiconductor substrate. A top layer defines firing chambers about each of the resistors. Propagation of a current or a "fire signal" through the resistor causes ink in a corresponding firing chamber to be heated and expelled through a corresponding nozzle.

In some printheads, fluid is routed to the firing chamber through a slot in the substrate. In some embodiments, the slot is formed while the substrate is part of a wafer die. Often, slots are formed in the wafer die by wet chemical etching of the substrate with, for example, Tetra Methyl Ammonium Hydroxide (TMAH) or potassium hydroxide (KOH). The etch rate for alkaline chemistries is different for different crystalline planes, and therefore the etch geometry is defined by the orientation of the crystalline planes. For example, on (100) substrates, TMAH etching techniques result in etch angles that cause a very wide backside slot opening. The wide backside opening limits how close the slots can be placed to each other on the die.

During processing, the substrate is often coated with masking films or layers that are substantially unaffected by the etchants. However, these films or layers are typically undercut as a result of extended etching time. Because of this, the etching time is often carefully monitored.

It is desired to efficiently etch slots in a die within certain dimensional tolerances, while maximizing the number of slots in the die.

SUMMARY

In one embodiment, a method of manufacturing a slotted substrate includes forming a masking layer over a first surface of a substrate, and patterning and etching the masking layer to form a hole therethrough. The first layer is deposited over the masking layer and in the hole. The first layer is patterned and etched to form a plug in the hole. A second surface of the substrate that is opposite the first surface is continuously etched until a bottom surface of the plug is substantially exposed and a slot in the substrate is substantially formed.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
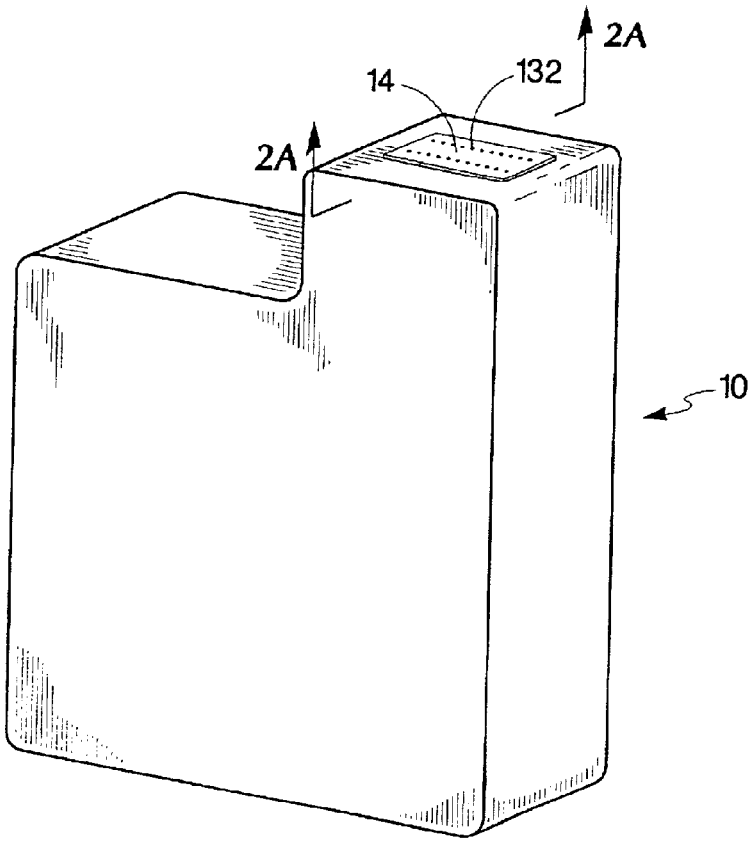
FIG. 1 illustrates a perspective view of an embodiment of a print cartridge of the present invention.
Figure 2A:
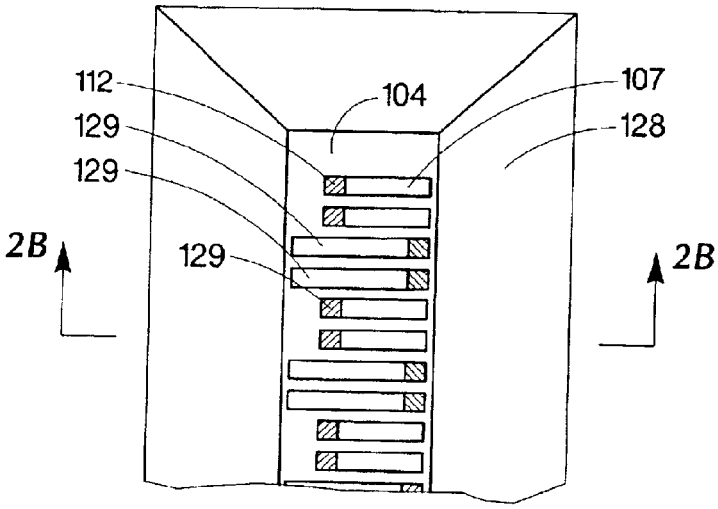
FIG. 2A illustrates a partial bottom view of an embodiment of the printhead of FIG. 1 shown through section 2A—2A.
Figure 2B:
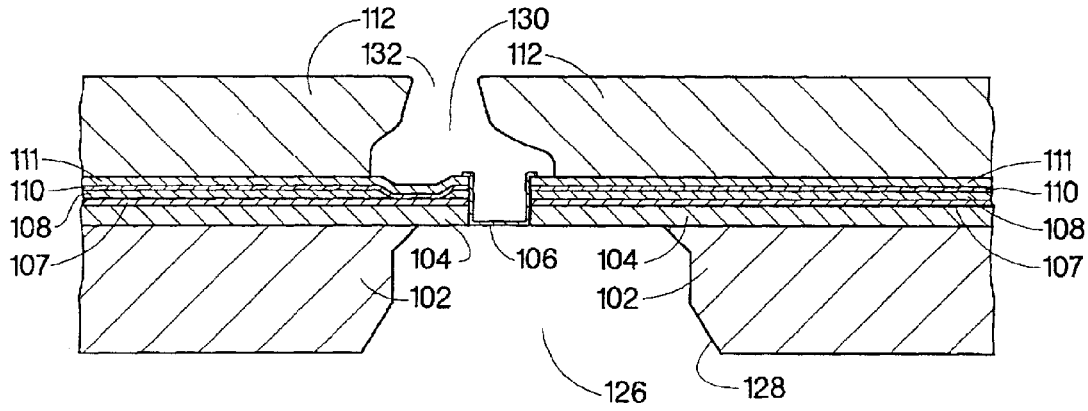
FIG. 2B illustrates a cross-sectional view of the printhead taken from section 2B—2B of FIG. 2A.

FIG. 1 is a perspective view of an inkjet cartridge 10 with a printhead 14 of an embodiment of the present invention. FIG. 2A illustrates a partial bottom view of the printhead through section 2A—2A of FIG. 1. FIG. 2B illustrates a cross-sectional view of the printhead where a thin film stack is applied over a substrate 102. A slot region 126 having sloped trench walls 128 is defined in the substrate 102. In one embodiment, the slot 126 is etched with dimensional control within 1 micron using the present invention. In an alternative embodiment, using this embodiment enables a higher density of slots to be etched in a given die.

As shown in the embodiment of FIGS. 2A and 2B, formed or deposited upon the substrate 102 are at least the following layers: a capping layer 104, a resistive layer 107, a conductive layer 108, a passivation layer 110, a cavitation barrier layer 111, and a barrier layer 112. The thin film stack is patterned and etched to form resistors of the resistive layer, conductive traces of the conductive layer, and a firing chamber 130 in the barrier layer. In one embodiment, the barrier layer 112 defines the firing chamber 130, and a nozzle orifice 132 associated with the firing chamber through which the fluid is ejected. Propagation of a current or a "fire signal" through a resistor causes the fluid in the firing chamber 130 to be heated and expelled through the nozzle orifice 132. In another embodiment, an orifice layer (not shown) having the orifices 132 is applied over the barrier layer 112.

As shown in FIGS. 2A and 2B, the sloped trench walls 128 of the slot 126 are formed under the rows of firing chambers and their corresponding resistors and orifices of the printhead. The capping layer 104 couples the trench walls 128 at a narrower slot section, as shown in FIG. 2A.

Figure 3:
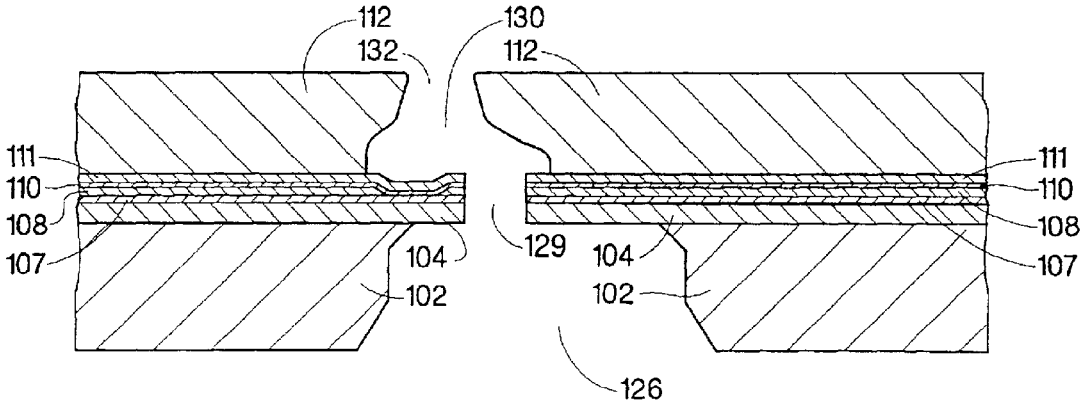
FIG. 3 illustrates an alternative embodiment to the cross-sectional view of FIG. 2B.

A channel 129, as shown in the embodiment of FIG. 3, is formed as a hole or fluid feed slot through the capping layer 104, and the rest of the thin film stack. The channel 129 fluidically couples the firing chamber 130 and the slot 126, such that fluid flows through the slot 126 and into the firing chamber 130 via channel 129. In one embodiment, entrances to the channels 129 are substantially rectangular and substantially parallel to each other along the capping layer 104, as shown in FIG. 2A. In one embodiment, each channel 129 leads from the slotted substrate to the corresponding firing chamber 130 through the thin film stack.

In another embodiment, as shown in FIG. 2*a*, at least two of the channels 129 fluidically couple the slotted substrate with a single firing chamber 130. In this embodiment, the channels 129 are used as a filter, such that if a particle is caught in one of the channels 129, the firing chamber 130 operates with fluid supplied through another of the channels 129 that is fluidically coupled with that firing chamber.

In one embodiment shown in FIG. 3, the slot 126 is formed after the thin film stack is deposited on the front side of the substrate. After the thin film layers 104, 107, 108, 110, 111 are formed, then the slot 126 is etched, as shown in FIG. 3. After the slot is formed, the layer 112 is then formed thereover.

In FIG. 2B, a front side protection (or plug) layer 106 is deposited in the channel 129, and then the layer 112 is deposited. The substrate is then etched to form the slot. After the slot is formed, the layer 106 is removed from the channel 129 with a BOE (buffered oxide etch), as described in more detail below. In one particular embodiment, no additional etching of the slot is performed after the plug is removed.

In the embodiment shown with regard to FIGS. 4, and 5 to 11, at least one layer is formed on the substrate 102 when the substrate is etched and the slot 126 is formed. For the sake of simplicity, the at least one layer formed on the substrate is shown as the capping layer 104. The layer 104 masks the substrate 102 to prevent inadvertent etching of the substrate. However, the present invention is not so limited to the one layer 104. Embodiments of the present invention include having any number and type of layers deposited over the substrate, depending upon the application for which the slotted substrate is to be utilized. Examples of such additional layers are described herein. In another embodiment, additional layers are deposited over the substrate after the slot is formed (and the front side protection 106 is removed).

Figure 4:
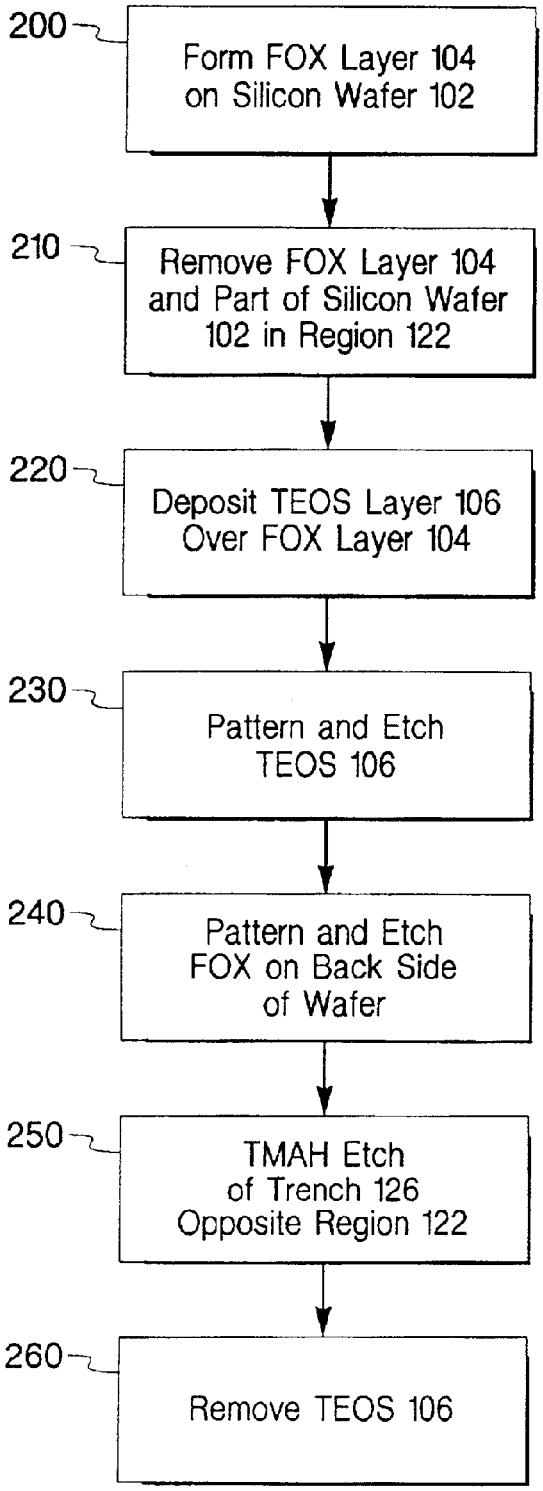
FIG. 4 illustrates a process flow chart of one embodiment of the manufacturing process for a slotted substrate according to the present invention.

In the embodiment described in the flow chart of FIG. 4, the slotted substrate is formed as illustrated in FIGS. 5 to 11. In one embodiment as shown in step 200, a first capping layer 104 is deposited or grown over a top surface of the substrate 102. In this embodiment, the capping layer 104 is FOX (field oxide) and the substrate 102 is a silicon wafer. In a step 210, the FOX layer is patterned and etched to form a hole through the FOX layer 104 and partially into the substrate 102. The hole defines a region 122 (See FIG. 5). In an alternative embodiment, the region 122 is the hole of the capping layer 104, and does not extend past the capping layer 104 into the substrate.

Figure 5:
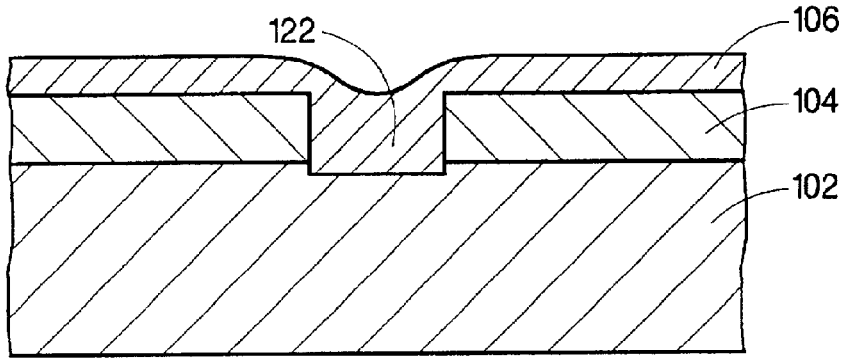
FIG. 5 illustrates a cross-sectional view of the substrate after one of the steps in FIG. 4 is completed.

As shown in FIG. 5, and described in step 220 of FIG. 4, the front side protection (FSP) layer 106 is deposited over the capping layer 104 and into the region 122. In the embodiment illustrated, the FSP layer 106 is TEOS (tetraethylorthosilicate). In one embodiment, the method of deposition for TEOS is CVD. In another embodiment, the FSP layer 106 is at least one of silicon dioxide, silane-based silicon dioxide, silicon nitride, field oxide, silicon carbide, and silicon oxynitride. In another embodiment, the method of deposition is PECVD. In one embodiment, in the area of the region 122, a top surface of the FSP layer 106 slopes down towards the substrate 102.

Figure 6:
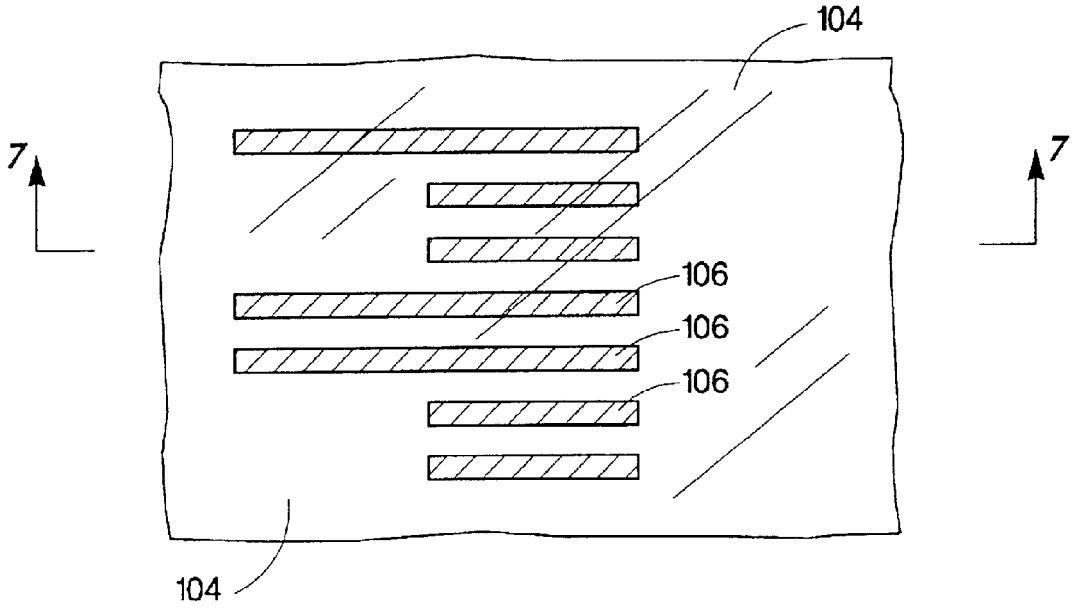
FIGS. 6 and 7 illustrate a plan view and a cross-sectional view of the substrate at the step subsequent to the step illustrated in FIG. 5.
Figure 7:
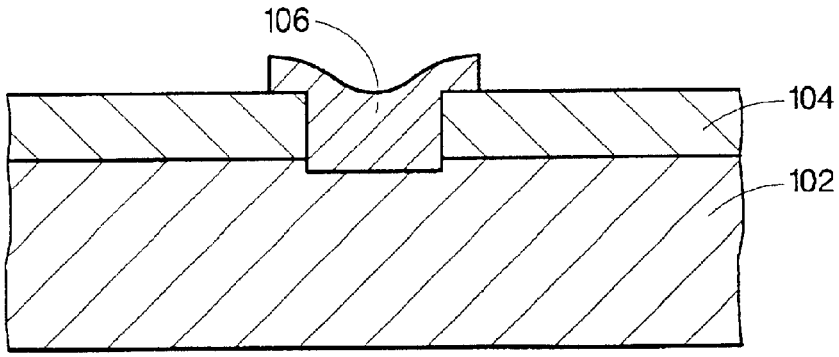

As shown in FIGS. 6 and 7, and described in step 230 of FIG. 4, the FSP layer 106 is patterned and etched to form a plug in the region 122. In one embodiment, the plug is elongated and extends across the layer 104 substantially following the region 122. In the embodiment shown, edges of the plug extend over the capping layer 104. FIG. 6 shows a top view of part of the coated substrate with the plugs of the FSP layer 106 (where the fluid feed channels 29 are to be formed, while FIG. 2A illustrates the fluid feed channels 29 from the bottom). In one embodiment, the plugs are substantially aligned in at least one of rows and columns. In another embodiment, the plugs are substantially not aligned with other plugs in the substrate.

Figure 8:
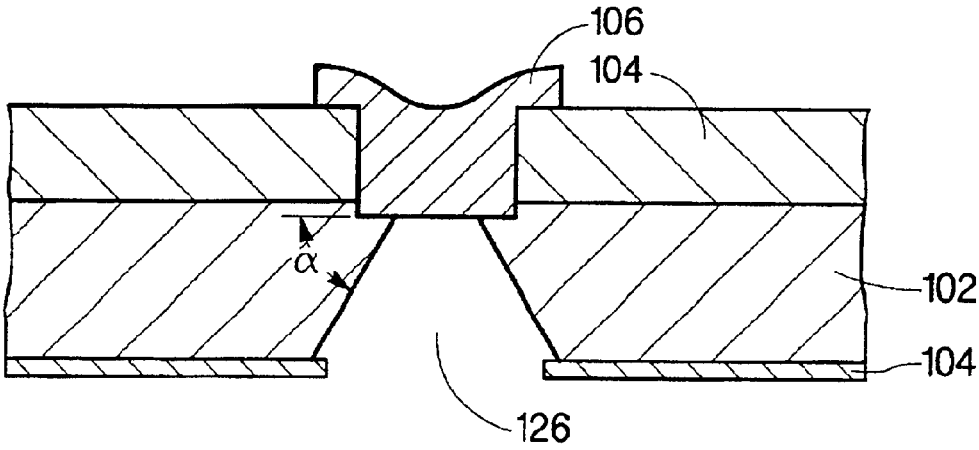
FIGS. 8 to 11 illustrate steps subsequent to the step illustrated in FIG. 7.

As shown in FIG. 8, and described in step 240 of FIG. 4, a second capping layer 104 is patterned and etched on a bottom surface (or back side) of the substrate, opposite the top surface. In step 240 of one embodiment, the etched area of the second capping layer corresponds to and is aligned with the region 122 at the front side of the substrate. The etched area of the second capping layer also corresponds to and defines a bottom area of the slot 126 to be etched through the substrate in one embodiment, as described in more detail below. In one embodiment, the second capping layer 104 is patterned and etched to expose the back side of the substrate opposite the region 122. In one embodiment, where the slot to be formed has substantially tapered walls, the exposed back side of the substrate has a much larger cross-sectional area than the region 122.

In another embodiment, the second capping (or masking) layer 104 is formed, patterned and etched on the back side of the substrate with the forming, patterning and etching of the capping layer 104 on the front side of the substrate in steps 200 and 210. In one embodiment, the second capping layer is of the same material as the first capping layer. In alternative embodiments, the first and second capping layers are different materials, and the second capping layer is a material that is discussed below as an alternative capping layer material.

Figure 9:
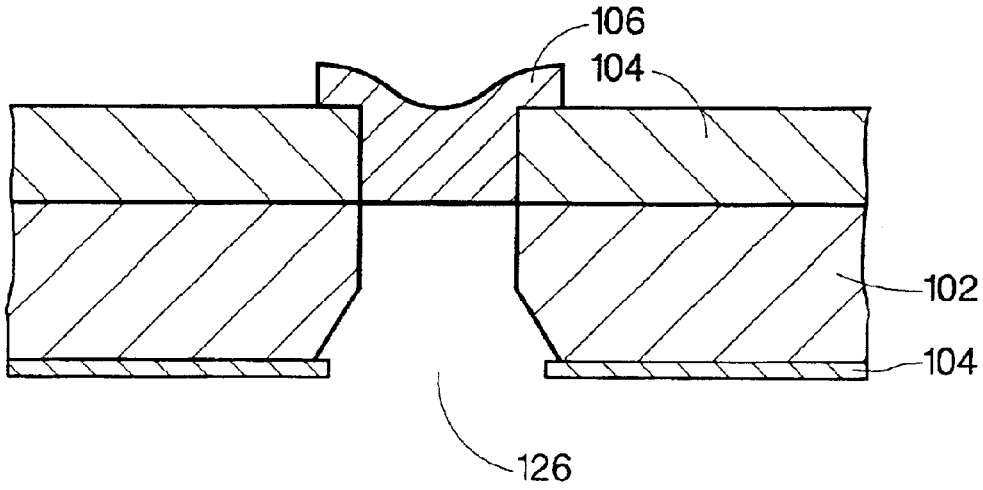
Figure 10:
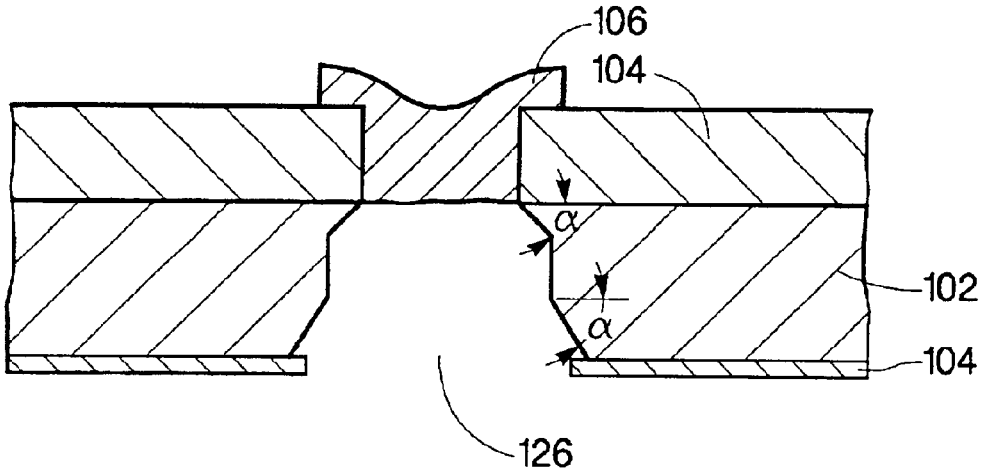

As described in step 250 of FIG. 4, and shown in FIGS. 8 to 10, the slot or trench 126 is etched from the back side of the substrate starting at the exposed area (the area not masked by the second capping layer 104). In one embodiment, the substrate is etched with TMAH (Tetra Methyl Ammonium Hydroxide). In another embodiment, the substrate is etched with potassium hydroxide (KOH) or another alkaline etchant. In one embodiment, the substrate is a silicon wafer with <100> orientation, such that the wafer is etched at an angle $\alpha$ of about 54.7 degrees with the front and back sides (top and bottom surfaces) of the substrate. The slot 126 begins at the exposed area and expands as a substantially pyramidal shape (with walls at an angle $\alpha$ of about 54.7 degrees) until a top of the pyramidal shape reaches the plug of the FSP layer 106, as shown in FIG. 8. Generally, the slot 126 expands in cross-sectional area in the substrate with increasing etch time.

As shown in FIG. 9, the wafer is etched to a further step from FIG. 8. In the embodiment shown, upon reaching the plug in FIG. 8, the slot then begins to expand along the FSP layer to a substantially truncated pyramidal shape. In one embodiment, the etch rate along the FSP/substrate interface is greater than the etch rate of the substrate alone and much greater than the FSP layer alone. In one embodiment, the FSP/substrate interface etch rate is greater than about twice the etch rate of the substrate prior to break through. In one embodiment, this faster etch along this FSP/substrate interface is called "etch back." Because of this 'etch back,' the substrate is etched along the interface to form slot walls that are not significantly angled (especially when compared with angle $\alpha$) in a top portion of the substrate, as shown in the process step of FIG. 9. In this embodiment, in the bottom portion of the substrate the sloped walls continue to expand in cross-sectional area during the etch, but remain at an angle $\alpha$ of about 54.7 degrees as they expand. In effect, the wet etched trenches in this embodiment rapidly align to edges of the front side protection structures. In one embodiment, the walls in the bottom portion of the substrate etch at a slower rate than the walls in the upper portion. Additionally in one embodiment, the FSP layer 106 is etched as well, but also at a slower rate than the substrate is etched.

In FIG. 10, the wafer is etched to a further step from FIG. 9. As shown in FIG. 10, in the top portion of the slot the walls are sloped with angle $\alpha$, and in the bottom portion of the slot the walls are also sloped with angle $\alpha$. In the embodiment shown, between the sloped walls of the top and bottom portions are middle walls coupling the substantially truncated pyramidal shapes. In one embodiment, these coupling middle walls are substantially straight. In effect, in this embodiment, the second capping (or masking) layer 104 substantially stopped the coupling middle walls, as well as the walls in the bottom portion, from expanding to the substantially pyramidal shape, as described in more detail below.

In forming the slot shown in FIG. 10, in the top portion, the substrate begins to etch at the angle α in the truncated pyramidal shape upon exposure of the capping layer at a capping/substrate interface. As the cross-sectional area of the slot increases at the top portion, the slot walls 128 along the bottom portion of the substrate also expand tending towards forming the substantially pyramidal shape throughout the entire slot. However, in this embodiment, the walls along the bottom portion of the substrate are substantially unable to expand much beyond edges of the second capping (or masking) layer 104. In one embodiment, the slow etch rate of the masking layer, and a tendency to maintain the angle α walls at the bottom portion, substantially keeps the slot 126 from expanding beyond the masking layer boundaries.

In one embodiment, the second capping layer 104, the FSP layer 106, and the first capping layer 104, are all etched at a much slower rate than the substrate. In one embodiment, the etch rate along the capping/substrate interface is greater than the etch rate of the substrate alone and much greater than the capping layer alone. In one embodiment, the etching is stopped when the shape of the slot reaches that as shown in FIG. 10. In an alternative embodiment, the substrate is etched for a long enough period and/or the second capping (or masking) layer 104 is masked such that the pyramidal shaped slot is formed. In one embodiment, the masking layer (or second capping layer) is patterned to keep the first capping layer 104 from being substantially undercut in undesirable areas.

In one embodiment, the channel entrance 129 for the fluid is not in the center of the slot 126 (see for instance, FIGS. 2A, 2B, and 6). The slotted substrate is formed substantially the same in either instance where the entrance 129 is centrally located or off-center, due to the "etch back" described with regard to FIG. 9. In particular, in the event that the back side masking layer 104 is not aligned precisely opposite the plug, and even taking the angle of the etched (100) substrate into account, the slotted substrate still is substantially formed as shown in FIGS. 4 to 11, and described above. In effect, the plug is utilized to align the trench to the hole etched into region 122 of the masking layer 104 on the front side of the substrate. As a result of this automatic aligning of the trench to the hole in the front side, dimensions of the hole (or channel 129 opening) substantially correspond to dimensions of the plug.

In one embodiment, after the slot breaks through the substrate, and interfaces with the FSP and/or capping layers are formed, the substrate first quickly etches along the FSP/substrate interface, then along the capping/substrate interface. Each of the adjacent (and substantially parallel) FSP/substrate interfaces (see FIGS. 2A and 6) etch toward forming the substantially truncated pyramidal shape slotted walls. Eventually, after etching for a time, the pyramidal shaped slots from each of the FSP/substrate interfaces overlap. After they overlap, the slots quickly combine and expand to their new boundaries, eventually becoming one large truncated pyramidal shaped slot 126 (see FIG. 2A). In one embodiment, as the slots overlap and expand, the capping/substrate interfaces between the FSP/substrate interfaces are also quickly etched.

In particular detail of this embodiment, as the slots are combining and the one large slot 126 is forming, the slot walls 128 are not yet aligned, due to the staggering of the regions 122 (see FIG. 6). However, each of the walls 128 of the one large slot have a tendency to eventually substantially align with each other throughout the substrate thereby reaching an equilibrium state of the truncated pyramidal shape. Consequently, the capping/substrate interfaces that surround the regions 122 (or FSP/substrate interfaces of FIG. 2A) etch back to align the slot walls 128 to each other. In this embodiment, the walls 128 substantially align with each other because the etch rate of the capping/substrate interface is greater than that for the substrate, especially when the slot is striving to reach the equilibrium state.

In one embodiment, for a wafer having a thickness of approximately 625 microns, the slot through the wafer is substantially formed and the TMAH process substantially complete in 12 hours. In another embodiment, the slot through the 625 micron wafer is substantially formed in 11½ hours. In another embodiment, the slot is formed between about 10½ and 12 hours, depending upon the size of the wafer and the size of the slot desired. The time for "etch back" for low BDD (bulk defect density) silicon wafers is between about ½ and 1 hour.

In one embodiment, the region 122 has a width that ranges from about 40 microns to about 120 microns, depending upon the substrate and processes used. In one embodiment, the region 122 width is about 80 to 110 microns.

Figure 11:
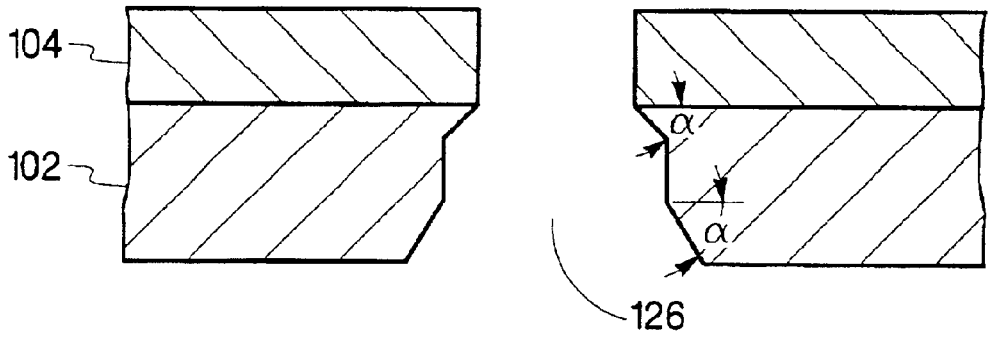

As described in step 260 of FIG. 4, and illustrated in FIG. 11, the FSP layer 106 or plug is removed from the region 122. In one embodiment, TEOS is removed with a buffered oxide etch (BOE). The BOE is a mix of hydrofluoric acid and ammonium fluoride. The etch is aqueous and may be any mixture strength of the two primary ingredients. In another embodiment, the hydrofluoric solution is diluted. In one embodiment, the BOE process is substantially completed in about 10 minutes. However, the BOE process may be completed in as little as 5 minutes.

In one embodiment, the substrate 102 is a monocrystalline silicon wafer. In one embodiment, the substrate wafer is low BDD (low number of imperfections in the silicon crystal lattice). The wafer has approximately 525 microns of thickness for a four-inch diameter or approximately 625 microns of thickness for a six-inch diameter. In one embodiment, the silicon substrate is p-type, lightly doped to approximately 0.55 ohm/cm.

In an alternative embodiment, the starting substrate may be glass, a semiconductive material, a Metal Matrix Composite (MMC), a Ceramic Matrix Composite (CMC), a Polymer Matrix Composite (PMC) or a sandwich Si/xMc, in which the x filler material is etched out of the composite matrix post vacuum processing. The dimensions of the starting substrate may vary as determined by one skilled in the art.

In one embodiment, the layer 104 covers and seals the substrate 102, thereby providing a barrier layer. Alternatively or additionally, the capping layer 104 electrically insulates the substrate 102. Capping layer 104 may be formed of a variety of different materials such as silicon dioxide, aluminum oxide, silicon carbide, silicon nitride, glass (PSG), and/or an electrically insulating dielectric material. In one embodiment, the capping layer 104 is a thermal barrier layer. The capping layer may be formed using any of a variety of methods known to those skilled in the art such as thermally growing the layer, sputtering, evaporation, and plasma enhanced chemical vapor deposition (PECVD). The thickness of capping layer may be any desired thickness sufficient to cover and seal the substrate. Generally, the capping layer has a thickness of up to about 1 to 2 microns.

In one embodiment, the layer 104 is a phosphorous-doped (n+) silicon dioxide interdielectric, insulating glass layer (PSG) deposited by PECVD techniques. Generally, the PSG layer has a thickness of up to about 1 to 2 microns. In one embodiment, this layer is approximately 0.5 micron thick and forms the remainder of the thermal inkjet heater resistor oxide underlayer. In another embodiment, the thickness range is about 0.7 to 0.9 microns.

In another embodiment, the capping layer 104 is field oxide (FOX) that is thermally grown on the exposed substrate 102. In one embodiment, the process grows the FOX into the silicon substrate as well as depositing it on top to form a total depth of approximately 1.3 microns. Because the FOX layer pulls the silicon from the substrate, a strong chemical bond is established between the FOX layer and the substrate.

In one embodiment, the resistive layer 107 is formed by depositing resistive material over the layer 104. In one embodiment, sputter deposition techniques are used to deposit a resistive material layer of tantalum aluminum composite. The composite has a resistivity of approximately 30 ohms/square. Typically, the layer forming the resistor has a thickness in the range of about 500 angstroms to 2000 angstroms. However, resistor layers with thicknesses outside this range are also within the scope of the invention.

A variety of suitable resistive materials are known to those skilled in the art including tantalum aluminum, nickel chromium, tungsten silicon nitride, and titanium nitride, which may optionally be doped with suitable impurities such as oxygen, nitrogen, and carbon, to adjust the resistivity of the material. The resistive material may be deposited by any suitable method such as sputtering, and evaporation.

In one embodiment, the conductive layer 108 is formed by depositing conductive material over the resistive layer 107. The conductive material is formed of at least one of a variety of different materials including aluminum, aluminum with about ½% copper, copper, gold, and aluminum with ½% silicon, and may be deposited by any method, such as sputtering and evaporation. Generally, the conductive layer has a thickness of up to about 1 to 2 microns. In one embodiment, sputter deposition is used to deposit a layer of aluminum to a thickness of approximately 0.5 micron. The conductive layer 108 and the resistive layer 107 are patterned and etched to form resistors and conductive traces.

As shown in the embodiment of FIG. 2, the insulating passivation layer 110 is formed over the resistors and conductor traces to prevent electrical charging of the fluid or corrosion of the device, in the event that an electrically conductive fluid is used. Passivation layer 110 may be formed of any suitable material such as silicon dioxide, aluminum oxide, silicon carbide, silicon nitride, and glass, and by any suitable method such as sputtering, evaporation, and PECVD. Generally, the passivation layer has a thickness of up to about 1 to 2 microns.

In one embodiment, a PECVD process is used to deposit a composite silicon nitride/silicon carbide layer 110 to serve as component passivation. This passivation layer 110 has a thickness of approximately 0.75 micron. In another embodiment, the thickness is about 0.4 microns. The surface of the structure is masked and etched to create vias for metal interconnects.

In one embodiment, the cavitation barrier layer 111 is added over the passivation layer 110. The cavitation barrier layer 111 helps dissipate the force of the collapsing drive bubble left in the wake of each ejected fluid drop from the firing chamber 130. Generally, the cavitation barrier layer has a thickness of up to about 1 to 2 microns. In one embodiment, the cavitation barrier layer is tantalum. The tantalum layer 111 is approximately 0.6 micron thick and serves as a passivation, anti-cavitation, and adhesion layer. In one embodiment, the cavitation barrier layer absorbs energy away from the substrate during slot formation. In this embodiment, tantalum is a tough, ductile material that is deposited in the beta phase. The grain structure of the material is such that the layer also places the structure under compressive stress. The tantalum layer is sputter deposited quickly thereby holding the molecules in the layer in place. However, if the tantalum layer is annealed, the compressive stress is relieved.

In one embodiment, the top (or barrier) layer 112 is deposited over the cavitation barrier layer 111. In one embodiment, the barrier layer has a thickness of up to about 20 microns. In one embodiment, the barrier layer 112 is comprised of a fast cross-linking polymer such as photoimagable epoxy (such as SU8 developed by IBM), photoimagable polymer or photosensitive silicone dielectrics, such as SINR-3010 manufactured by ShinEtsu™.

In another embodiment, the barrier layer 112 is made of an organic polymer plastic which is substantially inert to the corrosive action of ink. Plastic polymers suitable for this purpose include products sold under the trademarks VACREL and RISTON by E. I. DuPont de Nemours and Co. of Wilmington, Del. The barrier layer 112 has a thickness of about 20 to 30 microns. In another embodiment, the barrier layer 112 has an orifice plate deposited thereover.

It is therefore to be understood that this invention may be practiced otherwise than as specifically described. For example, the present invention is not limited to thermally actuated printheads, but may also include, for example, mechanically actuated printheads such as piezoelectric printheads, and medical devices. In addition, the present invention is not limited to printheads, but is applicable to any slotted substrates, such as for example, accelerometers (internal sensors), fuel cells, flextensional devices, optical switching devices, data storage/memory devices and visual display devices. Thus, the present embodiments of the invention should be considered in all respects as illustrative and not restrictive, the scope of the invention to be indicated by the appended claims rather than the foregoing description.

What is claimed is:

1. A method of manufacturing a slotted substrate comprising:

forming a masking layer over a front side of a substrate;

patterning and etching the masking layer to form a hole therethrough, wherein the hole exposes the substrate;

depositing a first layer over the masking layer and in the hole on the exposed substrate;

patterning and etching the first layer to form a plug in the hole;

etching a back side of the substrate until a bottom surface of the plug is substantially exposed and a slot in the substrate is substantially formed, wherein the plug substantially plugs up the slot, and wherein the plug substantially defines a fluid-feed passageway extending between the slot and a firing chamber; and, subsequently removing the plug and thereby at least partially defining the fluid-feed passageway.

2. The method of claim 1 wherein said removing comprises etching to remove the plug after etching the back side of the substrate to form the slot.

3. The method of claim 1 further comprising forming another masking layer over the back side of the substrate, and patterning and etching the other masking layer before etching the substrate.

4. The method of claim 1 wherein the substrate is etched with at least one of TMAH, KOH, and other alkaline etchants.

5. The method of claim 1 further comprising forming a recess in the substrate corresponding with the hole in the masking layer, wherein the plug extends into the recess.

6. The method of claim 1 wherein the first layer is at least one of silicon dioxide, silane-based silicon dioxide, silicon nitride, field oxide, silicon carbide, silicon oxynitride and TEOS.

7. The method of claim 1 further comprising etching an interface of the substrate and the first layer along the bottom surface of the plug at a first rate; and etching an interface of the substrate and the masking layer at a second rate that is slower than the first rate.

8. The method of claim 1 further comprising substantially etching an interface of the substrate and the first layer along the bottom surface of the plug in the etching of the substrate slot.

9. The method of claim 1 further comprising defining dimensions of an opening in the front side of the substrate by utilizing the plug, wherein dimensions of to plug substantially correspond to the dimensions of the opening.

10. The method of claim 1 further comprising utilizing the plug to align the trench to the hole etched into the masking layer on the front side of the substrate.

11. A method of manufacturing a fluid ejection device comprising:

forming a masking layer over a front side of a substrate;

patterning and etching the masking layer to form a hole therethrough;

depositing a first layer over the masking layer and in the hole and physically contacting the substrate below the hole to create an interface between the substrate and the first layer;

patterning and etching the first layer to form a plug in the hole; and etching from a back side of the substrate to the interface of the substrate and the first layer at the plug, thereby substantially forming a fluid slot in the substrate with the plug substantially plugging up the slot.

12. A substrate slotting method comprising:

forming a masking layer over a front surface of a substrate;

patterning and etching the masking layer to form a hole therethrough;

depositing a first layer over the masking layer and in the hole;

patterning and etching the first layer to form a plug in the hole; and, etching a back side of the substrate to remove substrate material until a bottom surface of the plug is substantially exposed and a slot in the substrate is substantially formed wherein the plug at least partially define the relative position of the slot at the front surface.

13. The method of claim 12, wherein said act of patterning and etching the first layer to form a plug comprises patterning and etching the first layer to form a plug that substantially defines a fluid-feed passageway configured to fluidly couple the slot and a firing chamber.

14. The method of claim 12, wherein maid act of etching forms the slot having dimensions at the first surface that substantially match the first area.

15. The method of claim 12, wherein said act of patterning and etching the masking layer exposes portions of the first surface of the substrate and wherein said depositing comprises depositing the first layer, at least a portion of which, directly contacts the first surface of the substrate and wherein substrate material defining the first surface and contacting the first layer etches faster than other portions of the substrate material defining the first surface but not contacting the first layer.

16. The method of claim 12, wherein said act of etching a back side of the substrate comprises etching the back side of the substrate and removing substrate material sequentially in a direction extending generally toward the first surface until a bottom surface of the plug is exposed and then etching generally laterally to form the slot respectively aligned at the first surface with the plug.

* * * * *